US009073655B2

(12) United States Patent
Bratsch

(10) Patent No.: US 9,073,655 B2
(45) Date of Patent: Jul. 7, 2015

(54) METHOD FOR PRODUCING FILLED AND RECLOSABLE PRESSURE VESSELS

(75) Inventor: Christian Bratsch, Salzburg (AT)

(73) Assignee: Xolution GmbH, München (DE)

( * ) Notice: Subject to any disclaimer, the term of this patent is extended or adjusted under 35 U.S.C. 154(b) by 0 days.

(21) Appl. No.: 13/878,688

(22) PCT Filed: Oct. 14, 2011

(86) PCT No.: PCT/EP2011/067955

§ 371 (c)(1),
(2), (4) Date: Jun. 3, 2013

(87) PCT Pub. No.: WO2012/049280

PCT Pub. Date: Apr. 19, 2012

(65) Prior Publication Data

US 2013/0264342 A1 Oct. 10, 2013

(30) Foreign Application Priority Data

Oct. 15, 2010 (AT) ..... A 1723/2010

(51) Int. Cl.

| | |
|---|---|
| ***B65B 7/28*** | (2006.01) |
| ***B65D 51/18*** | (2006.01) |
| ***B65B 55/06*** | (2006.01) |
| ***B65D 17/00*** | (2006.01) |
| ***B65D 51/00*** | (2006.01) |

(52) U.S. Cl.
CPC ..... *B65B 55/06* (2013.01); *B65D 17/166* (2013.01); *B65D 51/00* (2013.01)

(58) Field of Classification Search
CPC ..... B65B 7/2821; B65B 7/285; B65D 17/165
USPC ..... 53/471, 420, 421, 129.1, 485, 487, 281, 53/290, 440, 127; 220/254.7, 254.1, 623, 220/619, 626, 62.22, 62.12, 27, 270
See application file for complete search history.

(56) References Cited

U.S. PATENT DOCUMENTS

| | | | | |
|---|---|---|---|---|
| 3,383,008 | A * | 5/1968 | Lipske | 220/270 |
| 3,549,042 | A * | 12/1970 | Stolle et al. | 220/212 |
| 3,727,809 | A | 4/1973 | Douty | |
| 4,122,971 | A | 10/1978 | Potts | |

(Continued)

FOREIGN PATENT DOCUMENTS

| | | |
|---|---|---|
| FR | 2820407 | 8/2002 |

*Primary Examiner* — Stephen F Gerrity
*Assistant Examiner* — Eyamindae Jallow
(74) *Attorney, Agent, or Firm* — Dykema Gossett PLLC

(57) ABSTRACT

A filled and reclosable pressure vessel, in which a body is filled with a fluid, closed with a lid element (10, 100) and subjected to a heat treatment, with a lid surface (11, 110), and a closure (14) made of plastics as a lid element (10, 100), and at least one seal (16) arranged on the closure (14), the lid element (10, 100) being arranged in such a way that the closure (14) faces the interior of the sealed pressure vessel, wherein the lid surface (11, 110) and the closure (14) are arranged in such a way that the lid surface (11, 110) has a first distance (a1) from a first reference plane (E1) which substantially extends through the at least one sealing surface (16*a*) on the first surface (111) of the lid surface (11, 110), and the closure (14) extends at a second distance from a second reference plane which extends through the at least one seal (16), with the first distance (a1) being chosen to be larger than the second distance.

7 Claims, 2 Drawing Sheets

(56) References Cited

U.S. PATENT DOCUMENTS

| | | | | |
|---|---|---|---|---|
| 4,681,238 | A | 7/1987 | Sanchez | |
| 4,733,793 | A * | 3/1988 | Moen | 220/269 |
| 4,756,443 | A * | 7/1988 | Murayama | 220/270 |
| 4,762,245 | A * | 8/1988 | Matsubayashi et al. | 220/269 |
| 4,789,077 | A * | 12/1988 | Noe | 220/319 |
| 6,736,283 | B1 * | 5/2004 | Santamaria et al. | 220/619 |
| 2005/0242097 | A1 | 11/2005 | Morin | |
| 2006/0151503 | A1 | 7/2006 | Claydon | |
| 2009/0261699 | A1 | 10/2009 | Yu et al. | |
| 2010/0133275 | A1 * | 6/2010 | Phillips | 220/270 |
| 2010/0170204 | A1 | 7/2010 | Altheimer | |
| 2011/0240642 | A1 | 10/2011 | Zolcher | |
| 2011/0315684 | A1 | 12/2011 | Bratsch | |
| 2012/0273490 | A1 | 11/2012 | Jensen | |
| 2014/0041338 | A1 * | 2/2014 | Zabaleta et al. | 53/412 |

* cited by examiner

METHOD FOR PRODUCING FILLED AND RECLOSABLE PRESSURE VESSELS

BACKGROUND OF THE INVENTION

1. Field of the Invention

The present invention relates to a method for producing filled and reclosable pressure vessels, in which a vessel body with a cylindrical jacket and bottom part is filled with a fluid, whereupon it is non-detachably closed with a lid element and subsequently optionally subjected to a heat treatment, with a lid surface, preferably made of metal, and a closure means made of plastic being provided for use as a lid element, the closure means being fastened to a first surface of the lid surface, and at least one seal arranged on the closure means being brought into contact with at least one sealing surface arranged on the first surface of the lid surface, and the lid element formed by the lid surface and the closure means being arranged upon closing the pressure vessel in such a way that the closure means faces the interior of the sealed pressure vessel.

2. The Prior Art

Pressure vessels of the kind mentioned above are produced as recloseable beverage cans for example. In an especially advantageous embodiment of such beverage cans, an orifice is permanently provided in the lid surface, which is made of aluminum like the remainder of the can. This orifice is sealed by a closure means which rests on the lid surface in the interior of the can. This closure means carries a flap or a slide which can be actuated from the outside and which allows exposing the orifice for discharging the can and tightly sealing the can again after the first opening. Such a pressure vessel is disclosed for example in AT 507.950 AT of the applicant.

After the filling and closing, beverage cans are usually subjected to heat treatment in order to ensure the necessary sterility in that the content of the can is pasteurized. In this process, the can is briefly subjected to a temperature of over 60° C., as a result of which the pressure in the interior rises to several bars. The can is obviously deformed in this process, with especially the lid surface bulging to the outside. This bulging reverts back at least in part after cooling.

Similar effects can also occur by inadvertent heat treatment such as if the can is left in a motor vehicle for example and is subjected there temporarily to high temperatures which lead to a comparable pressure increase.

The increase in pressure is especially critical in cans which contain carbonated beverages, but it also occurs to a lower extent in other products.

It has now been noticed that beverage cans partly cannot be tightly sealed after pasteurizing and first opening. A deformation of the closure means in particular occurring in the course of the heat treatment and reverting back after cooling only partly was identified as the potential reason.

It is the object of the present invention to provide a method for producing a pressure vessel of the kind described above and especially with respect to a beverage can in which the performance of the required heat treatment does not have any negative effects on the reclosing ability and therefore the tightness of the pressure vessel.

SUMMARY OF THE INVENTION

This object is achieved in accordance with the invention by a method of the kind mentioned above in such a way that the lid surface comprises in at least one partial area a first distance from a first reference plane which substantially extends through the at least one sealing surface on the first surface of the lid surface, and the closure means extends in at least one partial area at a second distance from a second reference plane which extends through the at least one seal, with the first distance being chosen to be larger than the second distance.

The relevant aspect in the present invention is the fact that it is unavoidable that the closure means and the lid surface deform outwardly during heat treatment as a result of the arising internal pressure. The closure means assumes the sealing function, whereas the lid surface absorbs the major part of the pressure force, with the closure means resting on the lid surface. The deformation of the lid surface itself occurs in a substantially elastic manner, i.e. the lid surface reverts back to its original position without the occurrence of any other external forces after the cessation of the loading, i.e. during cooling. The closure means which is made of plastic is subjected to a certain extent to plastic deformation at increased temperature, i.e. at least a part of the curvature produced by the internal pressure remains after the cessation of the pressure load. This means that a closure means which is aligned parallel to the lid surface prior to the heat treatment and tightly rests on said lid surface will have a distance from said lid surface at its edge after the heat treatment. Consequently, the closure means will no longer sufficiently tightly seal the opening during reclosing the pressure vessel as a result of its deformation and the content of the pressure vessel might leak out. As a result of the configuration in accordance with the invention, the difference in the deformation behavior of lid surface and closure means will be compensated, which ideally occurs at such a point in time when the plastic deformation of the closure means corresponds precisely to the additional curvature of the lid surface in relation to the closure means.

In a preferred embodiment of the invention, the closure means is arranged in a substantially circular manner, with the at least one seal being arranged in the circumferential region and the closure means will seal a major part of the first surface of the lid surface after the sealing of the pressure vessel against the interior of the pressure vessel when the closure means is fastened to the lid surface. The closure means is arranged in a substantially disk-like way and is usually provided with a size which is similarly as large as the lid surface. It typically carries a seal at the edge with which it is sealed relative to the lid surface. It can also be provided that the seal is an integral part of the closure means, i.e., the closure means is produced by means of a two-component injection molding method for example.

It is provided in an especially preferred way that the central region of the lid surface has the maximum first distance from the first reference plane, with the lid surface being provided with an outwardly convex curvature prior to its connection with the closure means, which curvature leads to a superelevation of the middle region as compared to the edge in a range of between 1% and 5%, preferably between 2% and 3%, of the diameter of the lid surface.

When fastening the closure means to the first surface of the lid surface, a portion of the closure means is arranged to be spaced from the lid surface, with said distance decreasing in the course of a heat treatment performed after the closure of the pressure vessel. The distance between the lid surface and the closure means in the region of the center of the lid surface and closure means corresponds to the difference in the plastic deformation of the lid surface or closure means in the course of heat treatment.

The present invention further also relates to a pressure vessel with a vessel body comprising a cylindrical jacket and a bottom part for accommodating a fluid and a lid element which is non-detachably connected with the jacket, with the lid element consisting of a lid surface made of sheet metal, to which a closure means made of plastic is attached on the inside, which rests on the same over a large part of the surface area of the lid surface and which is sealed in relation to the lid surface on its circumference, and the lid surface is outwardly curved directly after the production of the pressure vessel when fastened in relation to the disk-like closure means, so that in the region of the center of the lid surface and the closure means there is a distance between them which preferably decreases in the course of a heat treatment.

BRIEF DESCRIPTION OF THE DRAWINGS

The invention will be explained below in greater detail by reference to a non-limiting embodiment shown in the drawings, wherein.

DETAILED DESCRIPTION OF THE DEPICTED EMBODIMENTS

Figure 1A:
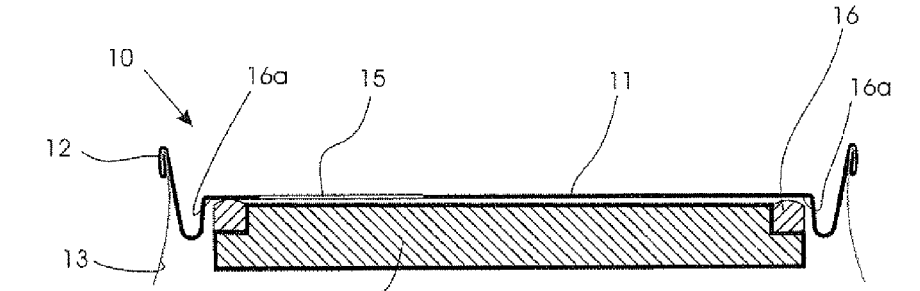
FIGS. 1*a* to show a lid element according to the state of the art before, during and after heat treatment.

FIG. 1*a* shows the lid element 10 of a pressure vessel, especially a beverage can according to the state of the art, wherein a lid surface 11 which is usually made of aluminum sheet metal or the like is in connection with the vessel wall 13 of the pressure vessel by way of a flange 12.

A closure means 14 made of plastic such as polypropylene (PP) is arranged on the bottom side of the lid surface 11. This closure means 14 is provided with the object of tightly sealing a drinking orifice 15 arranged in the lid surface 11 in the closed state of the pressure vessel by means of a seal 16 arranged in the circumferential region. In this case, the seal 16 rests on a sealing surface 16*a* on the inside of the lid surface 11. The pressure vessel as shown in FIG. 1*a* has not yet been subjected to any heat treatment.

Figure 1B:
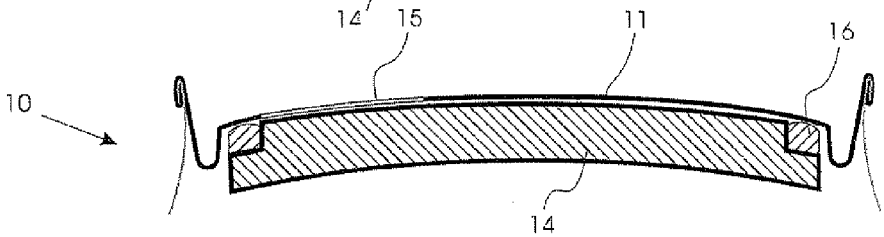

FIG. 1*b* shows the lid element 10 of FIG. 1*a* while it is being subjected to a heat treatment. It is clearly shown that the lid surface 11 and also the closure means 14 will bulge to the outside as a result of the higher pressure prevailing in the pressure vessel. As already mentioned, this increase in pressure can also occur for other reasons such as when the pressure vessel has been subjected to sunlight over prolonged periods of time or generally as a result of storage.

Figure 1C:
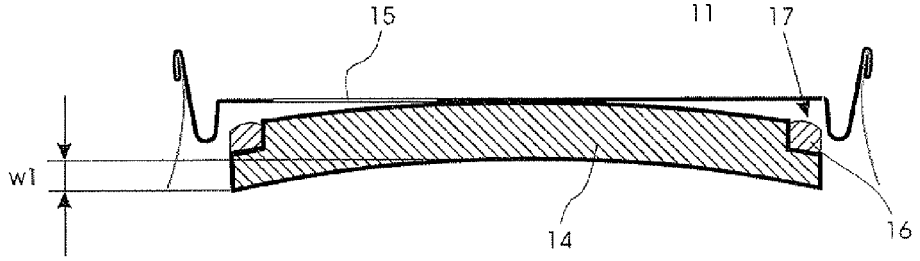

After the reduction of the pressure prevailing in the pressure vessel, e.g., after ending a heat treatment (FIG. 1*c*) or also by (first) opening of the pressure vessel, the lid surface 11 will return to its initial position (according to FIG. 1*a*). This return of the lid surface occurs as a result of its elastic properties. The closure means 14 on the other hand has been subjected to a permanent deformation in the form of an upward bulging with a height w1, so that especially in the boundary region between the lid surface 11 and closure means 14 a gap 17 is produced in the region of the seal 16. This gap 17, which need not necessarily occur over the entire circumference, causes a reduction or even cancellation of the sealing effect of the closure means 14 in interaction with the lid surface 11, so that optionally the content of the pressure vessel sealed with the closure means 14 can leak out via the drinking orifice 15.

Figure 2:
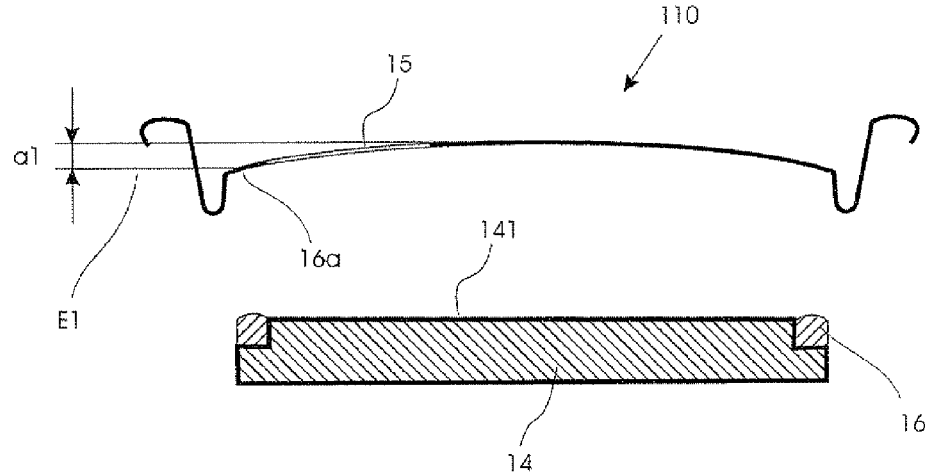
FIG. 2 shows a lid element in accordance with the invention before the fastening of the closure means to the lid surface.

In contrast thereto, the lid element 100 in accordance with the invention comprises a lid surface 110 which bulges to the outside (FIG. 2). This bulging is defined by a first distance a1 of the lid surface 110 from a reference plane E1 which extends substantially through the sealing surface 16*a*. The closure means 14 is arranged in this embodiment of the invention in a substantially planar manner as in the state of the art according to FIG. 1*a*.

Figure 3A:
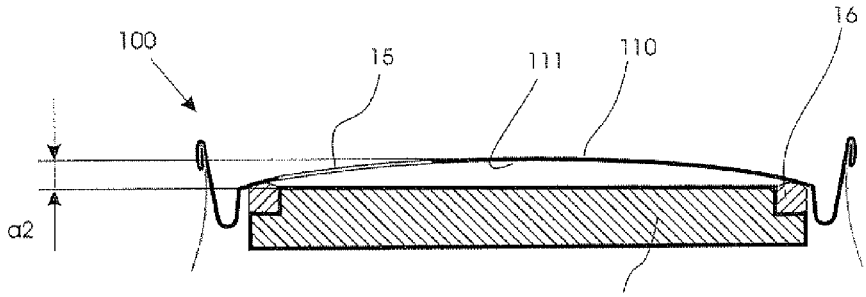
FIG. 3*a* to 3*c* show a sectional view of the lid element of FIG. 2 in accordance with the invention in the mounted state before, during and after the heat treatment, and FIGS. 4*a* and *b* show other embodiments of the invention before the fastening of the closure means to the lid surface.

In the mounted state (FIG. 3*a*), the upwardly bulging lid surface 110 and the substantially planar closure means 14 are arranged at a distance a2 from one another, which is at a maximum in the central region of the lid surface 110 and the closure means 14 while the seal 16 seals the region 111 of the drinking orifice 15 against the interior of the pressure vessel.

Figure 3B:
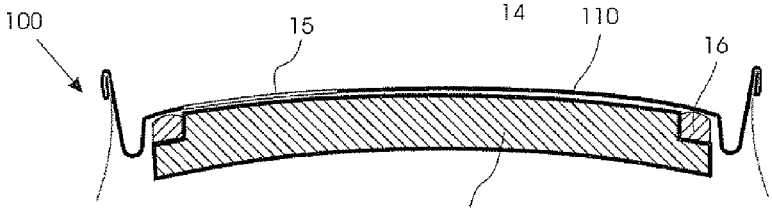

If this lid element 100 in accordance with the invention is subjected to a heat treatment (FIG. 3*b*), the closure means 14 is bulged upwardly together with the lid surface 110 as a result of the increased internal pressure, so that the upper side 141 (FIG. 2) of the closure means 14 is pressed against the bottom side of the lid surface 110. This is shown especially in FIG. 3*b*.

After the completion of the heat treatment, the closure means 14 remains spaced from the lid surface 110 at a substantially regular distance as a result of its permanent deformation, so that after the performed heat treatment there will not be any gap 17 as has been determined in the state of the art and the pressure vessel will also remain sealed in a reliably fluid-tight and gas-tight manner after reclosing. The curvature of the lid surface 110 or the distance a2 is optimally chosen way during the connection of the lid surface 110 with the closure means 14 in such a way that said distance a2 substantially corresponds to the height w1 of the deformation of the closure means 14 after the heat treatment.

Figure 3C:
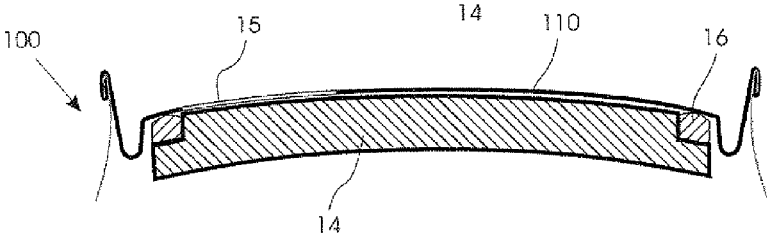
Figure 4A:
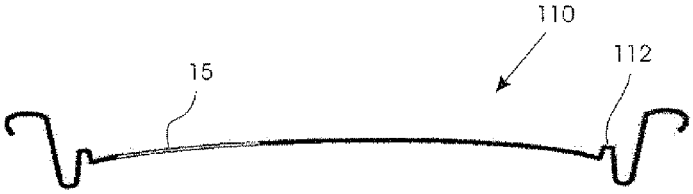
Figure 4B:
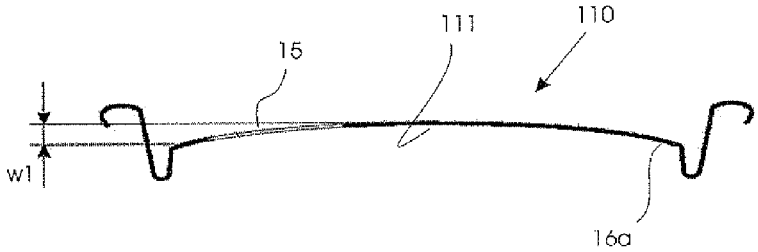

An other embodiment of the invention is shown in FIGS. 4*a* and 4*b*, wherein the lid element 100 consists of an annular protrusion 112 substantially parallel to the circumference of the lid. After heat treatment (FIG. 4*b*) the protrusion 112 has vanished by forming a sealing surface 16*a* for the accommodation of the seal 16 of the closure mean 14 (not shown) on the first surface 111 of the lid surface 110 as depicted in FIG. 3*c*.

It is provided in the present embodiment of the invention that the closure means is arranged in a substantially planar manner. Similarly, closure means will be used in the present invention as an alternative thereto which have a curvature already before the connection with the lid surface, with the second distance being defined as the line section which extends between the point of the highest bulging of the bottom edge of the closure means and a second reference plane which corresponds to the plane of a (fictitious) base on which the closure means 14 is disposed. In this case, this point need not necessarily be positioned in the central region of the closure element. In the case of a planar closure means this distance is equal zero.

It is understood that the invention is not limited to the embodiment as described above. As a result, the closure means and consequently the seal are not necessarily provided with a circular configuration with a diameter which substantially corresponds to the diameter of the lid surface, but can also be arranged in an elongated way with a respective seal in order to seal (or to reclose) the outlet opening of the pressure vessel in a fluid-tight or gas-tight manner. Similarly, the actuation of the closure means from the outside can occur in a large variety of ways by means of a slide for example, by twisting or tilting a trigger element, etc.

The invention claimed is:

1. A method for producing filled and reclosable pressure vessels, in which a vessel body with a cylindrical jacket and a bottom part is filled with a fluid, whereupon it is non-detachably closed with a lid element, with a lid surface and a closure means made of plastics being provided for use as a lid element, the closure means being fastened to a first surface of the lid surface, and at least one seal arranged on the closure means being brought into contact with at least one sealing surface arranged on the first surface of the lid surface, and the lid element formed by the lid surface and the closure means being arranged upon closing the pressure vessel in such a way that the closure means faces the interior of the sealed pressure vessel wherein the lid surface and the closure means are arranged in such a way that in at least one partial area the lid surface has a first distance from a first reference plane which substantially extends through the at least one sealing surface on the first surface of the lid surface, and the closure means extends in at least one partial area at a second distance from a second reference plane which extends through the at least one seal, with the first distance being chosen to be larger than the second distance.

2. The method according to claim 1, wherein the closure means is arranged in a substantially circular manner, with the at least one seal being arranged in the circumferential region and the closure means sealing a part of the first surface of the lid surface after the sealing of the pressure vessel against the interior of the pressure vessel when the closure means is fastened to the lid surface.

3. The method according to claim 1, wherein the central region of the lid surface is provided with the maximum first distance from the first reference plane, with the lid surface being provided with an outwardly convex curvature prior to its connection with the closure means, which curvature leads to a superelevation of the middle region as compared to the edge in a range of between 1% and 5% of the diameter of the lid surface.

4. The method according to claim 3, wherein said range of superelevation is between 2% and 3%.

5. The method according to claim 1, wherein when fastening the closure means to the first surface of the lid surface, a portion of the closure means is arranged to be spaced from the lid surface, with said third distance decreasing in the course of a heat treatment performed after the closure of the pressure vessel.

6. The method according to claim 1, wherein the pressure vessel is subjected to a heat treatment subsequent to non-detachably closing the vessel body with the lid element.

7. The method according to claim 1, wherein the lid surface consists of metal.

* * * * *